US007410738B2

(12) United States Patent
Yanus et al.

(10) Patent No.: US 7,410,738 B2
(45) Date of Patent: Aug. 12, 2008

(54) IMAGING MEMBER HAVING FIRST AND SECOND CHARGE TRANSPORT LAYERS

(75) Inventors: John F. Yanus, Webster, NY (US); Kenny-Tuan T. Dinh, Webster, NY (US); Markus R. Silvestri, Fairport, NY (US); H. Bruce Goodbrand, Hamilton (CA); M. John Hinckel, Rochester, NY (US); Dale S. Renfer, Webster, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 10/775,986

(22) Filed: Feb. 10, 2004

(65) Prior Publication Data

US 2005/0175910 A1 Aug. 11, 2005

(51) Int. Cl.
*G03G 5/047* (2006.01)

(52) U.S. Cl. ..... 430/58.5; 430/58.05; 430/970; 430/58.8

(58) Field of Classification Search ..... 430/58.05, 430/58.5, 58.8, 970
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,338,387 | A | 7/1982 | Hewitt | 430/58 |
| 4,988,597 | A | 1/1991 | Spiewak et al. | 430/62 |
| 5,008,173 | A * | 4/1991 | Mimura et al. | 430/78 |
| 5,130,222 | A * | 7/1992 | Otsuka et al. | 430/126 |
| 5,192,633 | A * | 3/1993 | Iwasaki et al. | 430/970 |
| 5,215,840 | A | 6/1993 | Itami et al. | |
| 5,380,613 | A | 1/1995 | Ueda et al. | |
| 5,567,557 | A | 10/1996 | Mori et al. | |
| 6,017,665 | A * | 1/2000 | Grune et al. | 430/58.2 |
| 6,261,729 | B1 * | 7/2001 | Yuh et al. | 430/65 |
| 2002/0025483 | A1 * | 2/2002 | Kawamura et al. | 430/59.6 |
| 2003/0087171 | A1 * | 5/2003 | Tokutake et al. | 430/970 |

FOREIGN PATENT DOCUMENTS

| | | |
|---|---|---|
| EP | 0 823 668 | 2/1998 |
| EP | 1 109 068 | 6/2001 |

OTHER PUBLICATIONS

Diamond, Arthur S & David Weiss (eds.) Handbook of Imaging Materials. NewYork: Marcel-Dekker, Inc. (Nov. 2001) pp. 145-164.*
Horgan, Anthony M., et al., U.S. Appl. No. 10/320,808, filed Dec. 16, 2002 on Imaging Members.
Wu, Jin et al., U.S. Appl. No. 10/369,816, filed Feb. 19, 2003 on Photoconductive Imaging Members.

* cited by examiner

*Primary Examiner*—Christopher RoDee
(74) *Attorney, Agent, or Firm*—Eugene O. Palazzo; Fay Sharpe LLP

(57) ABSTRACT

A photoconductive imaging member containing an optional supporting substrate, an optional hole blocking layer thereover, a photogenerating layer and a charge transport layer, and wherein the charge transport layer contains a phenol of, for example, the alternative formulas

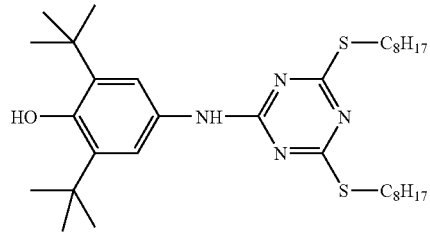

or

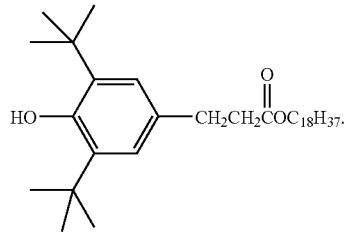

23 Claims, No Drawings

IMAGING MEMBER HAVING FIRST AND SECOND CHARGE TRANSPORT LAYERS

CROSS-REFERENCE TO RELATED APPLICATIONS

Illustrated in copending U.S. patent application Ser. No. 10/320,808, entitled Imaging Member, filed Dec. 16, 2002, the disclosure of which is totally incorporated herein by reference, is an imaging member comprised of a photogenerating layer, (1) a first charge transport layer comprised of a charge transport component and a resin binder, and thereover and in contact with the first layer (2) a second top charge transport layer comprised of a charge transport component, a resin binder and certain hindered phenol dopants.

There is illustrated in copending U.S. Ser. No. 10/369,816, filed Feb. 19, 2003, entitled Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/370,186, filed Feb. 19, 2003, entitled Photoconductive Imaging Members, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

The appropriate components and processes of the above copending applications, inclusive of the photogenerating components, the charge transport components and the hole transport components, blocking and adhesive layers, top overcoating layer, and the like, can be selected for the present invention in embodiments thereof.

BACKGROUND

This invention relates in general to layered imaging members, inclusive of flexible members and substantially rigid members, or OPC members, comprised, for example, of a photogenerating layer and a charge transport layer, and wherein the charge transport layer contains certain hindered phenols of the formulas illustrated herein, and which phenols are available as IRGANOX 565™ and CYANOX 2176™, available, for example, from Ciba Chemicals. The aforementioned phenols primarily function as an antioxidant and which antioxidant prevents, or minimizes the charge transport components degradation by exposure to ozone.

More specifically, disclosed herein is an electrophotographic imaging member comprised in sequence of a supporting substrate, a hole blocking layer, an adhesive layer, a photogenerating layer, and a charge transport layer containing charge, especially hole transport components, a polymer binder, the hindered phenols illustrated herein, which phenols can function as an effective anti-ozonant to eliminate or suppress the charge transport polymer binder molecular chain scission to permit the prevention of chain backbone break down into low molecular weight polymer fragments that converts the charge transport layer into a brittle coating layer. Furthermore, in embodiments the illustrated herein are electrophotographic imaging members may also contain a plurality of layers, such as two charge transport layers comprising a first (bottom) charge transport layer, which is in contiguous contact with the photogenerating layer, and a second (top) charge transport layer coated over the first charge transport layer. The bottom charge transport layer can comprise a binary solid solution of a charge transport compound and a polymer binder, whereas the top charge transport layer is comprised of a charge transport compound, a polymer binder, and a hindered phenol of the formulas illustrated herein.

Advantages associated with the imaging members of the present invention, in embodiments, thereof include, for example, the avoidance of or minimal undesirable migration of the hindered phenol to the photogenerating layer to thereby avoid imaging member instability, such as electrical performance degradation, and undesirable electrical characteristics especially on long term cycling of the member; coating of two transport layers in separate passes to, for example, minimize the transport layers thickness variations, which variations can cause image defects referred to as rain drops; minimizing and in embodiments avoiding an increase in the lateral surface conductivity of the member which in turn can cause image degradation, referred to as lateral conductivity migration (LCM), and which disadvantages are minimized or avoided with the members of the present invention.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this invention are useful in color xerographic applications, particularly high-speed color copying and printing processes, and which members are in embodiments sensitive in the wavelength region of, for example, from about 500 to about 900 nanometers, and in particular from about 650 to about 850 nanometers, thus diode lasers can be selected as the light source.

REFERENCES

Electrophotographic imaging members may be multilayered photoreceptors that comprise a substrate support, an electrically conductive layer, an optional charge blocking layer, an optional adhesive layer, a charge generating layer, a charge transport layer, and an optional protective or overcoating layer. The imaging members can be of several forms, including flexible belts, rigid drums, and the like. For a number of multilayered flexible photoreceptor belts, an anticurl layer may be employed on the backside of the substrate support, opposite to the side carrying the electrically active layers.

In U.S. Pat. No. 4,265,990, the disclosure of which is totally incorporated herein by reference, there is illustrated a layered photoreceptor with a separate charge generating layer (CGL) and a separate charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,265,990; 4,233,384; 4,306,008; 4,299,897 and 4,439,507, the disclosures of each of these patents being totally incorporated herein by reference in their entirety.

In multilayer photoreceptor devices, one property, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization can establish an upper limit to the concentration of the transport molecules that can be dispersed in a binder. Thus, there is desired an imaging member that exhibits excellent performance properties and minimizes lateral conductivity migration of the charge image pattern, and which characteristics may be achievable by including in the member a hindered phenol and wherein the hindered phenol is present, for example, in an amount of from about 2 weight percent to about 10 weight percent, and more specifically in an amount of from about 5 to about 8 percent by weight.

SUMMARY

Aspects and features disclosed herein relate to a photoconductive imaging member comprised of a supporting substrate, an optional hole blocking layer thereover, a photogenerating layer and a charge transport layer, and wherein the charge transport layer contains a hindered phenol of, for example, the alternative formulas

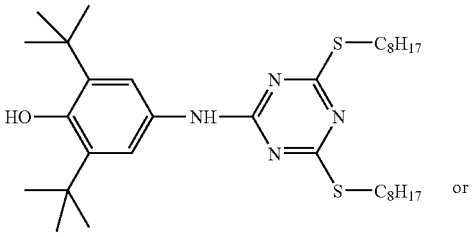

Irganox 565

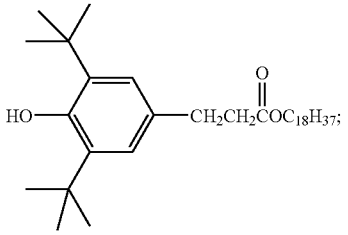

Cyanox 2176 a member comprised of a photogenerating layer and a charge transport layer, and wherein the charge transport layer contains

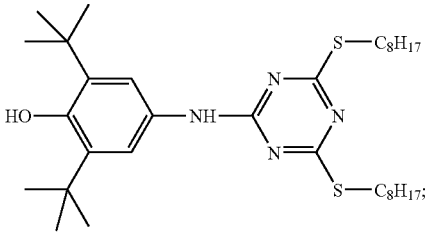

Irganox 565 a member comprised of a photogenerating layer and a charge transport layer, and wherein the charge transport layer contains

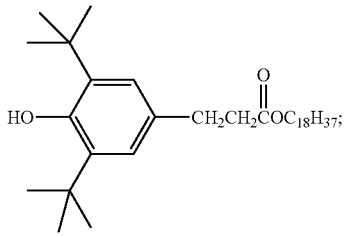

Cyanox 2176 an electrophotographic imaging member comprising a photogenerating layer, (1) a first charge transport layer comprised of a charge transport component and a resin binder, and thereover and in contact with the first charge transport layer (2) a second top charge transport layer comprised of a charge transport component, a binder resin or polymer and a hindered phenol, and wherein the migration of the hindered phenol is avoided or minimized.

Examples of the hindered phenols selected for the members illustrated herein, and which phenols are available from Ciba Specialty Chemicals are IRGANOX 565®-4-[{4,6-bis[octylthio]-5-triazin-2-yl}amino]-2,6-di-[tert]-butyl phenol; CYANOX 2176®-octadecyl-3,5-bis[1,1-dimethylethyl]-4-hydroxybenzene propanoate also known as octadecyl-3,5-di-t-butyl-4-hydroxyhydrocinnamate; and the like.

In embodiments a plurality of charge transport layers, such as two, are selected. For the application of each of the charge transport layers there can be selected a number of known suitable organic solvents, such as methylene chloride, toluene and tetrahydrofuran, and wherein the total solid, that is charge transport and binder amount ratio to total solvent amount, is, for example, from about 10:90 weight percent to about 30:70 weight percent, and in embodiments, from about 15:85 weight percent to about 25:75 weight percent. The dual or two separate charge transport layers can be deposited in two passes, wherein for the first pass the first charge transport layer is coated on the photogenerating layer, and wherein during the second pass the second charge transport layer is coated on the first charge transport layer and the charge transport compounds are substantially soluble in a styrene/hindered phenol polymer, and also wherein the styrene/hindered phenol polymer can replace a portion of the resin binder in the second pass, such as a polycarbonate binder. The first layer can comprise suitable charge transport compounds, such as an aryl amine like N,N'-diphenyl-N,N'-bis(3-methylphenyl)-[1,1'-biphenyl]-4,4'-diamine and a polymer binder; and the second charge transport layer can comprise suitable charge transport compounds, such as an aryl amine like N,N'-diphenyl-N,N'-bis(3-methylphenyl)-[1,1'-biphenyl]-4,4'-diamine and a hindered phenol. Any suitable and conventional techniques may be utilized to apply the charge transport layer coating solutions, such as, for example, spraying, dip coating, extrusion coating, roll coating, wire wound rod coating, draw bar coating, and the like. Each of the dried charge transport layers possess in embodiments a thickness of, for example, from about 5 to about 500 micrometers, and more specifically, a thickness of, for example, from about 10 micrometers to about 50 micrometers. In specific embodiments, the total thickness of the two charge transport layers is about 25 micrometers. In general, the ratio of the thickness of the charge transport layer to the charge generating layer is, in embodiments, maintained at from about 2:1 to about 200:1, and in some instances about 400:1, and wherein the second or top charge transport layer possesses excellent wear resistance. The charge generating layer, dual charge transport layers and optional layers may be applied in any suitable order to provide either positive or negative charging photoreceptors. For example, the charge generating layer may be applied prior to the charge transport layer, as illustrated in U.S. Pat. No. 4,265,990. In embodiments, the charge transport layers are employed upon a charge generating layer, and the charge transport layers may optionally be overcoated with an overcoat and/or protective layer.

The photoreceptor substrate may be opaque or substantially transparent, and may comprise any suitable organic or inorganic material having the requisite mechanical properties. The substrate can be formulated entirely of an electrically conductive material, or it can be an insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium, and the like, or exclusively be made up of a conductive material, such as aluminum, chromium, nickel, brass, and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 65 micrometers to about 3,000 micrometers, and in embodiments, from about 75 micrometers to about 1,000 micrometers for optimum flexibility and minimum induced surface bending stress when cycled around small diameter rollers, for example 19 millimeter diameter rollers. The surface of the substrate layer is, in embodiments, cleaned prior to coating to promote greater adhesion of the deposited coating composition. Cleaning may be effected by, for example, exposing the surface of the substrate layer to plasma discharge, ion bombardment, and the like methods. Similarly, the substrate can be either rigid or flexible. In embodiments, the thickness of this layer is from about 3 millimeters to about 10 millimeters. For flexible belt imaging members, for example, substrate thicknesses are from about 65 to about 150 microns, and in embodiments, from about 75 to about 100 microns for optimum flexibility and minimum stretch when cycled around small diameter rollers of, for example, 19 millimeter diameter. The entire substrate can comprise the same material as that in the electrically conductive surface or the electrically conductive surface can be merely a coating on the substrate. Any suitable electrically conductive material for passing or preventing the passage of holes into and out of the conductive layer can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in a thickness of from about 50 Angstroms to about 100 centimeters. When a flexible electrophotographic imaging member is desired, the thickness of the conductive layer typically is from about 20 Angstroms to about 750 Angstroms, and in embodiments, from about 100 to about 200 Angstroms for an excellent combination of electrical conductivity, flexibility, and light transmission.

A hole blocking layer may be applied to the substrate in contact with the conductive layer, or in contact with the substrate when a conductive layer is absent. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors, such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material of, for example, polymers, such as polyvinylbutyral, epoxy resins, polyesters, polysiloxanes, polyamides, polyurethanes, and the like, or may be nitrogen containing siloxanes or nitrogen containing titanium compounds, such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387; 4,286,033 and 4,291,110, the disclosures of which are totally incorporated herein by reference. Other suitable charge blocking layer polymer compositions are also described in U.S. Pat. No. 5,244,762, such as vinyl hydroxyl ester and vinyl hydroxy amide polymers, wherein the hydroxyl groups have been partially modified to benzoate and acetate esters and which modified polymers are then blended with other unmodified vinyl hydroxy ester and amide unmodified polymers, such as such a blend of a 30 mole percent benzoate ester of poly(2-hydroxyethyl methacrylate) and poly(2-hydroxyethyl methacrylate). Also, suitable charge blocking layer polymer compositions are described in U.S. Pat. No. 4,988,597, the disclosure of which is totally incorporated herein by reference.

The blocking layer in embodiments may be continuous and may have a thickness of less than from about 10 micrometers, and more specifically, from about 1 to about 5 micrometers. In embodiments, a blocking layer of from about 0.005 micrometer to about 1.5 micrometers facilitates charge neutralization after the exposure step and optimum electrical performance is achieved. The blocking layer may be applied by any suitable conventional technique, such as spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution with the solvent being removed after deposition of the coating by conventional techniques, such as by vacuum, heating, and the like. Generally, a weight ratio of blocking layer material and solvent of from about 0.05:100 to about 5:100 is satisfactory for spray coating.

If desired, an optional adhesive layer may be formed on the substrate, and more specifically, between a layer on the substrate and the photogenerating layer. Any suitable adhesive may be used, such as polyesters, polyarylates, polyurethanes, and the like. Any suitable solvent may be used to form an adhesive layer coating solution, such as tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer can for example, be applied directly to the charge blocking layer. Thus, the adhesive layer is, in embodiments, in direct contiguous contact with both the underlying charge blocking layer and the overlying charge generating layer to enhance adhesion bonding and to effect ground plane hole injection suppression. Drying of the deposited coating may be effected by any suitable conventional process, such as oven drying, infrared radiation drying, air drying, and the like. The adhesive layer should be continuous and can be of a thickness of from about 0.01 micrometer to about 2 micrometers after drying. In embodiments, the dried thickness is from about 0.03 micrometer to about 1 micrometer.

The components of the photogenerating layer comprise photogenerating particles, including know photogenerating pigments of, for example, metal phthalocyaines, metal free phthalocyanines, vanadyl phthalocyanines, titanyl phthalocyanines, perylenes, such as BZP perylenes, hydroxy gallium phthalocyanines, gallium phthalocyanines, selenium, selenium alloys, trigonal selenium, and the like, and more specifically, Type V hydroxygallium phthalocyanine, x-polymorph metal free phthalocyanine, and chlorogallium phthalocyanine photogenerating pigments dispersed in a polymer binder. A Type V hydroxygallium phthalocyanine possesses X-ray powder diffraction (XRPD) peaks at, for example, Bragg angles (2 theta +/−0.2°) of 7.4, 9.8, 12.4, 16.2, 17.6, 18.4, 21.9, 23.9, 25, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5, such as from about 1 to about 4 micrometers.

Photogenerating layer thicknesses of from about 0.05 micrometer to about 100 micrometers can be selected and, in embodiments, this layer can be from about 0.05 micrometer to about 40 micrometers thick. The photogenerating binder layer containing photoconductive compositions and/or pigments, and the resinous binder material, in embodiments, ranges in thickness of from about 0.1 micrometer to about 5 micrometers, and in embodiments, has a thickness of from about 0.3 micrometer to about 3 micrometers for improved light absorption and improved dark decay stability and mechanical properties.

For example, from about 10 percent by volume to about 95 percent by volume of the photogenerating pigment may be dispersed in from about 40 percent by volume to about 60 percent by volume of the film forming polymer binder composition, and in embodiments, from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments, from about 25 to about 75 percent by weight, and the binder is present in an amount of from about 20 to about 95 percent by weight, and in embodiments, from about 25 to about 75 percent by weight, although the relative amounts can be outside these ranges. The photogenerating layer containing photoconductive compositions and the resinous binder material generally ranges in thickness of from about 0.05 micron to about 10 microns or more, and in embodiments, from about 0.1 micron to about 5 microns, and in more specific embodiments having a thickness of from about 0.3 micron to about 3 microns, although the thickness may be outside these ranges. The photogenerating layer thickness is related to the relative amounts of photogenerating compound and binder with the photogenerating material often being present in amounts of from about 5 to about 100 percent by weight. Higher binder content compositions generally require thicker layers for photogeneration. Generally, it is desirable to provide the photogenerating layer in a thickness sufficient to absorb about 90 percent or more of the incident radiation which is directed upon it in the imagewise or printing exposure step. The maximum thickness of this layer is dependent primarily upon factors, such as mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infrared radiation drying, air drying, and the like.

Any suitable film forming binder may be utilized in the photoconductive or photogenerating layer. Examples of suitable binders for the photoconductive materials include thermoplastic and thermosetting resins, such as polycarbonates, polyesters including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific inactive binders include polycarbonate resins with a weight average molecular weight of from about 20,000 to about 100,000. In embodiments, a weight average molecular weight of from about 50,000 to about 100,000 is specifically selected. More specifically, there can be selected as a binder poly (4,4'-diphenyl-1,1'-cyclohexane carbonate) polycarbonate; poly(4,4'-diphenyl-1,1'-cyclohexane carbonate)-500 with a weight average molecular weight of about 51,000; or poly(4,4'-diphenyl-1,1'-cyclohexane carbonate)-400 with a weight average molecular weight of about 40,000.

The charge transport layer is normally transparent in a wavelength region in which the electrophotographic imaging member is to be used when exposure is effected therethrough to ensure that most of the incident radiation is utilized by the underlying charge generating layer. The charge transport layer should exhibit negligible charge generation, and discharge, if any, when exposed to a wavelength of light useful in xerography, e.g., 4,000 to 9,000 Angstroms. When used with a transparent substrate, imagewise exposure or erase may be accomplished through the substrate with all light passing through the substrate. Thus, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer with, for example, a thickness of from about 5 to about 75, and more specifically, from about 10 to about 40 microns, functions to primarily trap minimal charges, either holes or electrons, passing through this layer. Generally, there can be selected for the charge transport layer a number of known charge transport components including, for example, aryl amines such as those of the following formula

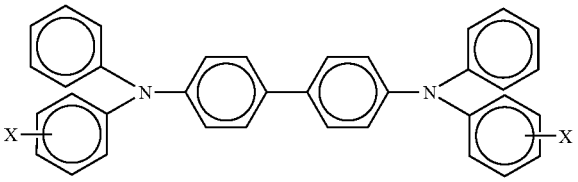

wherein X is an alkyl group, an alkoxy group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the film forming polymer binder materials for the charge transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Typically, the transport layer contains from about 10 to about 75 percent by weight of a charge transport component, and more specifically, from about 35 percent to about 50 percent of this component molecularly dispersed or dissolved in a polymer binder.

Specific inactive binders selected for the charge transport layer include polycarbonate resins with a weight average molecular weight of from about 20,000 to about 250,000. In embodiments, a weight average molecular weight of from about 80,000 to about 250,000 is specifically preferred. More specifically, excellent imaging results are achieved with poly (4,4'-isopropylidene diphenyl carbonate) binder having a weight average molecular weight of 120,000. Alternatively, another polycarbonate, such as poly(4,4'-diphenyl-1,1'-cyclohexane carbonate) with a weight average molecular weight of 250,000, is also a suitable binder. The preferred charge transport compound selected for mixing with the polycarbonate binder to prepare the charge transport layer is N,N'-diphenyl-N,N'-bis(3-methylphenyl)-[1,1'-biphenyl]-4,4'-diamine.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semiconductive matrices.

The following Examples are provided.

EXAMPLE I

An electrophotographic imaging member web stock was prepared by providing a 0.02 micrometer thick titanium layer coated on a biaxially oriented polyethylene naphthalate substrate (KADALEX™, available from ICI Americas, Inc.) having a substrate thickness of 3.5 mils (89 micrometers) and applying thereto, using a gravure coating method, a solution containing 10 grams of gamma aminopropyltriethoxy silane, 10.1 grams of distilled water, 3 grams of acetic acid, 684.8 grams of 200 proof denatured alcohol and 200 grams of heptane. This layer was then allowed to dry for 5 minutes at 135° C. in a forced air oven. The resulting blocking layer had an average dry thickness of 0.05 micrometer as measured with an ellipsometer.

An adhesive interface layer was then applied to the above blocking layer by extrusion processes and utilizing a wet coating containing 5 percent by weight based on the total weight of the solution of the polyester adhesive (Mor-Ester 49,000, available from Morton International, Inc.) in a 70/30 volume ratio mixture of tetrahydrofuran/cyclohexanone. The adhesive interface layer was allowed to dry for 5 minutes at 135° C. in the forced air oven. The resulting adhesive interface layer had a dry thickness of 0.065 micrometer.

A slurry coating solution of 40 percent by volume of hydroxygallium phthalocyanine and 60 percent by volume of poly(4,4'-diphenyl-1,1'-cyclohexane carbonate) (PCZ-200, available from Mitsubishi Gas Chem.) dispersed in tetrahydrofuran was extrusion coated onto the above adhesive interface layer. The resulting photogenerating layer was dried at 135° C. for 5 minutes in a forced air oven to form a photogenerating layer with a dry thickness of 0.4 micrometer layer.

EXAMPLE II

The photogenerator layer of Example I was coated with a hole transport layer in two passes of equal thickness resulting in a total, final thickness of 29 microns. The first layer hole transport layer in contact with the photogenerating layer was comprised of 50 percent by weight (based on total solids) of the hole transport compound N,N'-diphenyl-N,N'-bis(3-methyl-phenyl)-(1,1'-biphenyl)-4,4'-diamine

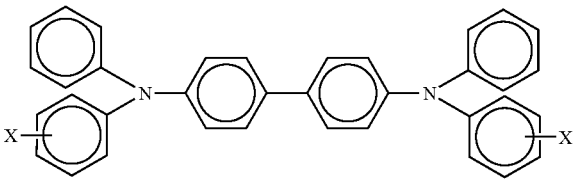

wherein X is a methyl group attached to the meta position, and 50 percent by weight (based on total solids) of the polycarbonate resin MAKROLON 5705™, a poly(4,4'-isopropylidene-diphenylene) carbonate available from Farbenfabricken Bayer A.G. The second hole transport top layer was comprised of 46.6 percent by weight (based on total solids) of the hole transport compound N,N'-diphenyl-N,N'-bis(3-methyl-phenyl)-(1,1'-biphenyl)-4,4'-diamine, 46.6 percent by weight (based on total solids) of the polycarbonate binder resin MAKROLON 5705™, and 6.8 percent by weight of the antioxidant IRGANOX 1010™, pentaerythritol tetrakis(3-(3,5-di-tert-butyl-4-hydroxyphenyl) propionate), available from Ciba Spezialitatenchemie AG.

EXAMPLE III

An electrophotographic imaging member web stock was prepared by the processes and using some of the same materials above Example II with the exception that the second hole transport layer, 29 micrometers in thickness, contained CYANOX 2176™ in place of IRGANOX 565™. MAKROLON™, 9.4 grams, was dissolved in 106 grams of methylene chloride. After the polymer was completely dissolved, 9.4 grams of N,N'-diphenyl-N,N'-bis(3-methylphenyl)-1,1'-biphenyl-4~4'-diamine was added and stirring was accomplished. Finally, 1.2 grams of CYANOX 2176™ were added and the mixture resulting was agitated to obtain a solution comprising 48 weight percent of N,N'-diphenyl-N,N'-bis(3-methylphenyl)-1,1'-biphenyl-4~4'-diamine, 48 weight percent of the MAKROLON™ polymer binder and 2 weight percent of CYANOX 2176™. The resulting solution was then applied using a 4 mil Bird bar to form a coating which upon drying had a thickness of 29 micrometers.

EXAMPLE IV

An electrophotographic or photoconductive imaging member web stock was prepared by the procedure and using some of the same materials as above, reference Example III, with the exception that the charge transporting layer contained IRGANOX 565™ in place of CYANOX 2176™. MAKROLON™, 9.4 grams, was dissolved in 106 grams of methylene chloride. After the MAKROLON™ polymer was dissolved, 9.4 grams of N,N'-diphenyl-N,N'-bis(3-methylphenyl)-1,1'-biphenyl-4~4'-diamine was added and stirring was accomplished until dissolution. Finally, 1.2 grams of IRGANOX 565™ were added and the mixture resulting was stirred to obtain a solution comprising 48 weight percent of the hole transport N,N'-diphenyl-N,N'-bis(3-methylphenyl)-1,1'-biphenyl-4~4'-diamine, 48 weight percent of the MAKROLON™ polymer binder and 2 percent by weight of IRGANOX 565™. The resulting solution was applied onto the photogenerator layer using a 4 mil Bird bar to form a coating which upon drying had a thickness of 29 micrometers.

EXAMPLE V

Coated photoconductive samples of Examples II to IV were cut into small rectangulars (1.5 inches×8 inches) and were wrapped around a photoreceptor aluminum cylindrical drum. The samples were then exposed to corona effluence produced from two scorotron wires operating at 700 to 800V and 900 to 1,700 μA; the exposure time was usually about 30 to about 35 minutes. Exposed samples were then immediately placed inside a Xerox Corporation Document series printer for printing. The print target consisted of a series of isolated lines with the widths varying between about 1 pixel to about 5 pixels; the resolution was 600 spots per inch; how well the samples performed against the corona was determined by the visibility of those lines. Lines with low widths disappeared first. A sample, which prints no visible bit lines in the exposed area, possessed poor anti-deletion protection. The degree of anti-deletion protection of a sample was determined by the number of visible bit pixel lines in the exposed area. Samples of Examples II through IV were tested simultaneously to minimize test variability. The sample of Example II exhibited a wipe-out, none of the pixel lines would print out in the exposed area indicating poor deletion resistance. The samples of Examples III and IV printed lines with widths of 3, 4, and 5 pixels; only the 1 and 2 pixel lines disappeared.

EXAMPLE VI

The devices of Examples III and IV were mounted on a cylindrical aluminum drum which was rotated on a shaft. The devices were then charged by a corotron mounted along the circumference of the drum. The surface potentials were measured as a function of time by several capacitively coupled probes placed at different locations around the shaft. The probes were calibrated by applying known potentials to the drum substrate. The film (photogenerating/hole transport layers) on each drum was exposed and erased by light sources located at appropriate positions around the drum. Measurements were accomplished by charging the photoconductor devices in a constant current or voltage mode. As the drum rotated, the initial charging potential was measured. Further rotation led to the exposure station, where the photoconductor devices were exposed to monochromatic radiation of known intensity. The surface potential after exposure was also measured. The devices were then exposed to an erase lamp of an appropriate intensity and any residual potentials were measured. A photo induced discharge characteristics curve was obtained by plotting the potentials as a function of exposure. Table I includes the image potential after an exposure of 6 erg/cm$^2$ of the devices that were charged up to an initial potential of 800V. There is a larger increase within 10,000 cycles in the image potential at 6 erg/cm$^2$ of Examples III and IV in respect to the reference sample of Example II. This increase can be reduced by decreasing the doping level of the CYANOX™ with little or no sacrifice of the devices resistance to deletion. Devices at 30 percent doping levels printed at least 4 and 5 pixel lines in contrast to the reference devices with no IRGANOX™ or CYANOX™ where all lines disappeared. Table I also includes the sensitivities of the devices in terms of how much exposure was needed to discharge an initial potential from 800V to its half value of 400V. The slow increase over imaging 10,000 cycles confines itself within 20 percent a change. This variation can be minimized by optimizing the CYANOX™ doping level without substantial sacrifice to the deletion resistance.

TABLE I

| | At T = 0 cycles | | At T = 10,000 cycles | |
|---|---|---|---|---|
| SAMPLE | Potential at 6 erg/cm$^2$ in V | $V_0/2$ Exposure in erg/cm$^2$ | Potential at 6 erg/cm$^2$ in V | $V_0/2$ Exposure in erg/cm$^2$ |
| Example II - Reference | 41 | 0.98 | 51 | 1.07 |
| Example III - IRGANOX ™ | 75 | 1.07 | 167 | 1.28 |
| Example IV - CYANOX ™ | 78 | 1.02 | 109 | 1.18 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of a supporting substrate, an optional hole blocking layer thereover, a photogenerating layer, a first charge transport layer in contiguous contact with the photogenerating layer, the first charge transport layer consisting of a charge transport compound and a polymer binder, and a second charge transport layer coated over the first charge transport layer, the second charge transport layer consisting of a charge transport compound, a polymer binder, and a hindered phenol of the formula

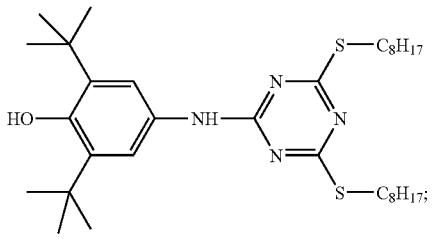

wherein the total thickness of the two charge transport layers is about 29 microns, and the first and second transport layers are of equal thickness.

2. An imaging member in accordance with claim 1 wherein said hindered phenol is present in an amount of from about 1 to about 10 weight percent.

3. An imaging member in accordance with claim 1 wherein said hindered phenol is present in an amount of from about 0.5 to about 7 weight percent.

4. An imaging member in accordance with claim 1 wherein said hindered phenol is present in an amount of from about 1 to about 4 weight percent.

5. An imaging member in accordance with claim 1 wherein said hindered phenol is present in an amount of from about 0.5 to about 2 weight percent.

6. An imaging member in accordance with claim 1 further including a hole blocking layer.

7. An imaging member in accordance with claim 6 wherein said hole blocking layer is comprised of titanium oxide and a phenolic resin.

8. An imaging member in accordance with claim 1 comprised in the following sequence of said supporting substrate, said hole blocking layer, an optional adhesive layer, said photogenerating layer, said first charge transport layer, and said second charge transport layer.

9. An imaging member in accordance with claim 8 wherein the adhesive layer is present, and which layer is comprised of a polyester optionally with an $M_w$ of from about 50,000 to about 75,000, and an $M_n$ of about 25,000 to about 45,000.

10. An imaging member in accordance with claim 1 wherein the supporting substrate is comprised of a conductive metal substrate.

11. An imaging member in accordance with claim 10 wherein the conductive substrate is aluminum, aluminized polyethylene terephthalate or titanized polyethylene terephthalate.

12. An imaging member in accordance with claim 1 wherein said photogenerating layer is of a thickness of from about 0.05 to about 10 microns.

13. An imaging member in accordance with claim 1 wherein the photogenerating layer is comprised of photogenerating pigments dispersed in a polymer, and which pigments are present in an amount of from about 5 percent by weight to about 95 percent by weight.

14. An imaging member in accordance with claim 1 wherein the charge transport compound in each of the first and second charge transport layers is independently an aryl amine molecule.

15. An imaging member in accordance with claim 14 wherein the aryl amine is of the formula

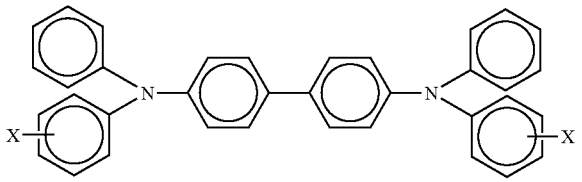

wherein X is selected from the group consisting of alkyl and halogen, and optionally wherein the aryl amine is dispersed in a resinous binder.

16. An imaging member in accordance with claim 15 wherein the aryl amine is N,N'-diphenyl-N,N-bis(3-methyl phenyl)-1,1'-biphenyl-4,4'-diamine.

17. An imaging member in accordance with claim 1 further including an adhesive layer of a polyester with an $M_w$ of from about 35,000 to about 70,000, and an $M_n$ of from about 25,000 to about 41,000.

18. An imaging member in accordance with claim 1 wherein the photogenerating layer is comprised of metal phthalocyanines or metal free phthalocyanines.

19. An imaging member in accordance with claim 1 wherein the photogenerating layer is comprised of titanyl phthalocyanines, perylenes, or hydroxygallium phthalocyanines.

20. An imaging member in accordance with claim 1 wherein the photogenerating layer is comprised of Type V hydroxygallium phthalocyanine.

21. A method of imaging which comprises generating an electrostatic latent image on the imaging member of claim 1 developing the latent image, and transferring the developed electrostatic image to a suitable substrate.

22. A member in accordance with claim 1, and which member is flexible.

23. A member in accordance with claim 1, and which member is rigid.

* * * * *